United States Patent [19]

Phillips

[11] Patent Number: 4,519,200

[45] Date of Patent: May 28, 1985

[54] TEXTILE YARNS WITH LOOPS AND FREE PROTRUDING ENDS

[75] Inventor: Bobby M. Phillips, Kingsport, Tenn.

[73] Assignee: Eastman Kodak Company, Rochester, N.Y.

[21] Appl. No.: 525,388

[22] Filed: Aug. 22, 1983

[51] Int. Cl.[3] ..... D02G 3/24; D02G 1/16

[52] U.S. Cl. ..... 57/246; 57/2; 57/208; 57/248; 57/350; 428/369; 428/397; 428/400

[58] Field of Search ..... 57/2, 284, 289, 208, 57/238, 239, 243–248, 350, 209; 28/271–276; 428/364, 373, 369–371, 374, 397, 400

[56] References Cited

U.S. PATENT DOCUMENTS

| | | | |
|---|---|---|---|
| 2,783,609 | 3/1957 | Breen | 57/350 X |
| 2,852,906 | 9/1958 | Breen | 57/350 |
| 2,869,967 | 1/1959 | Breen | 57/350 X |
| 3,219,739 | 11/1965 | Breen et al. | 57/248 X |
| 3,249,669 | 5/1966 | Jamieson | 57/248 X |
| 3,251,181 | 5/1966 | Breen et al. | 57/248 X |
| 3,545,057 | 12/1970 | Lubach | 28/273 |
| 3,857,233 | 12/1974 | Cardinal et al. | 57/289 X |
| 4,041,583 | 8/1977 | Hart et al. | 28/273 X |
| 4,245,001 | 1/1981 | Phillips et al. | 428/397 X |
| 4,332,761 | 6/1982 | Phillips et al. | 28/273 X |

*Primary Examiner*—John Petrakes

*Attorney, Agent, or Firm*—Malcolm G. Dunn; Daniel B. Reece, III

[57] ABSTRACT

Textile yarn having a staple yarn character and including continuous filaments with each continuous filament being formed into coils, loops or whorls at random intervals along its length, each continuous filament having a main body section with a portion thereof along the length of the main body section being intermittently separated from the main body section and a fraction of the intermittently separated portion being broken and providing free ends extending from the main body section.

5 Claims, 5 Drawing Figures

TEXTILE YARNS WITH LOOPS AND FREE PROTRUDING ENDS

DESCRIPTION

This invention is directed to an improved continuous filament yarn having a loopy structure made from continuous filaments each having free ends protruding from along its length.

Historically, fibers used by man to manufacture textiles, with the exception of silk, were of short length. Vegetable fibers such as cotton, animal fibers such as wool, and bast fibers such as flax all had to be spun into yarns to be of value in producing fabrics. However, the very property of short staple length of these fibers requiring that the yarns made therefrom be spun yarns also resulted in bulky yarns having very good covering power, good insulating properties, and a good, pleasing hand.

The operations involved in spinning yarns from staple fibers are rather extensive and thus are quite costly. For example, the fibers must be carded and formed into slivers and then be subsequently drawn to reduce the diameter and finally be spun into yarn.

Textile yarns having only loopy structures to provide bulk, insulation, etc., are well known in the art. U.S. Pat. No. 2,783,609 and a related continuation-in-part U.S. Pat. No. 2,852,906, for example, disclose a continuous filament yarn that is described as achieving a bulk equal to or superior to that of comparable staple yarns due to being composed of a plurality of substantially continuous individually convoluted filaments. The individual filaments shown in the patent are described as having "coils, loops or whorls" at random intervals along their lengths. The patent states that unless otherwise indicated, the term "loops" in the specification refers to tiny complete loops formed by a filament doubling back upon itself, crossing itself, and then proceeding in substantially the original direction, and that in mathematics a curve of this type is said to have a crunode. The loops are thus termed "crunodal loops" so as to distinguish them from other forms of loops. The majority of loops visible on the surface of the yarn are of a roughly circular or ring-like shape. These readily visible filament loops are said to contribute to bulkiness, and that the less obvious convolutions of the filaments within the yarn provide a lateral interfilament spacing which is important in producing the bulk and resulting garment warmth of fabrics made from this yarn. The process for making this yarn involves jetting a stream of air or other compressible fluid rapidly from a confined space to form a turbulent region. Then yarn to be treated is fed into the fluid stream so that the yarn is supported by the fluid stream and the individual filaments are separated from each other and whipped about violently in the turbulent region. Merely removing these separated filaments from the turbulent region for reassembly into a yarn accomplishes the desired result of forming loops and other convolutions at random intervals along each filament and irregularly spaced on different filaments. The filaments are described as having been whipped about in the turbulent zone sufficiently to form convolutions that are retained during withdrawal, windup, and further processing.

U.S. Pat. No. 2,869,967 discloses a convoluted filament yarn that is similarly formed as in the disclosed U.S. Pat. No. 2,783,609, but the yarn also has what is described as protruding fiber ends irregularly spaced along the yarn surface. This is accomplished by feeding the yarn through a jet operated under conditions such that the filaments are shattered at random intervals to provide the desired free ends of projecting fiber. The jet not only separates the filaments of the yarn but also the jet turbulence is such as to whip the filaments about with such rapidity that the flex life of the material is quickly exceeded and some or many of the filaments are broken. These completely broken filaments form the protruding fiber ends.

U.S. Pat. No. 4,245,001 and the related process U.S. Pat. No. 4,332,761, disclose a continuous filament yarn having a spun yarn character. The yarn forms a bundle of continuous filaments with each filament having a continuous body section with at least one wing member extending from and along the body section, the wing member being intermittently separated from the body section, and a fraction of the separated wing members being broken to provide free protruding ends extending from the body section to provide the spun yarn character of the continuous filament yarn. The yarn is further characterized in that portions of the wing member are separated from the body section to form bridge loops, the wing member portion of the bridge loop being attached at each end thereof to the body section. The wing member portion of the bridge loop is shorter in length than the corresponding body section portion. The free protruding ends extending from the filaments have a mean separation distance along a filament of about one to about ten millimeters and have a mean length of about one to about ten millimeters. The free protruding ends are randomly distributed along the filaments. The mean length of the wing member portion of the bridge loops is about 0.2 to about 10.0 millimeters and the mean separation distance of the bridge loops along a filament is about 2 to about 50 millimeters. The bridge loops are randomly distributed along the filaments.

SUMMARY OF THE INVENTION

Textile yarns of this invention have a staple yarn character and include continuous filaments, each continuous filament formed into coils, loops or whorls at random intervals along its length and comprising a continuous main body section having a portion thereof along the length of the main body section being intermittently separated from the main body section and a fraction of the intermittently separated portion being broken and providing free ends extending from the main body section.

The textile yarn of the present invention may also include other filaments, either continuous or noncontinuous, in addition to the continuous filaments described herein. The presence or absence of these "other filaments" would depend upon the use intended for the yarn.

The number of loops formed in the form of crunodal loops may vary from about 50 to about 1500 per meter. The fractured free protruding ends projecting from each of the continuous filaments have a mean separation distance along a filament of about one to about ten millimeters, and a mean length of about one to about ten millimeters.

The textile yarn of the invention may also have formed therein localized highly entangled knots or slubs at intervals along its length.

BRIEF DESCRIPTION OF THE DRAWINGS

The details of my invention will be described in connection with the accompanying drawings, in which.

BEST MODE FOR CARRYING OUT THE INVENTION

Figure 1:
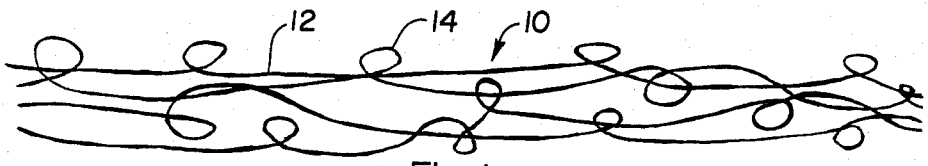
Fig. 1 Prior Art
FIG. 1 is a sketch representative of a typical loopy yarn of the prior art such as that disclosed in U.S. Pat. No. 2,783,609.

FIG. 1 shows a sketch representative of a continuous filament yarn 10 having a loopy structure such as disclosed in U.S. Pat. No. 2,783,609. The filaments 12 are each formed into a series of ring-like or crunodal loops 14 in the manner disclosed in the patent. Yarns such as these traditionally provide aesthetics which are wool-like. Loops, especially crunodal type loops, are strained structures and are relatively stiff, hence the wool or worsted aesthetics.

Figure 2:
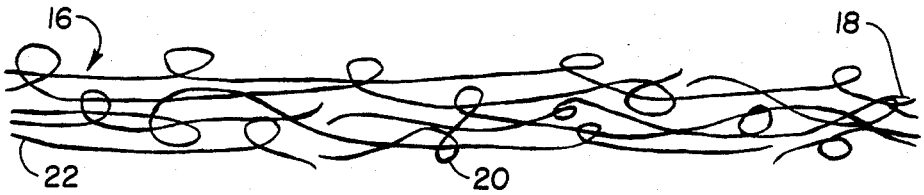
Fig. 2 Prior Art
FIG. 2 is a sketch representative of a typical loopy yarn of the prior art having projecting fiber ends such as that disclosed in U.S. Pat. No. 2,869,967.

FIG. 2 shows a sketch representative of a continuous filament yarn 16 having a loopy structure such as disclosed in U.S. Pat. No. 2,869,967. The filaments 18 are each formed into a series of ring-like or crunodal loops 20, with some of the filaments being completely broken to provide free ends 22 in the manner disclosed in the patent.

Figure 3:
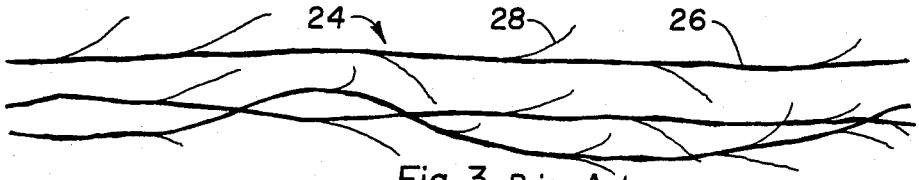
Fig. 3 Prior Art
FIG. 3 is a sketch representative of a typical spun-like yarn made from continuous filaments which have protruding free ends such as that disclosed in U.S. Pat. No. 4,245,001.

FIG. 3 shows a sketch representative of a continuous filament yarn 24 wherein each of the continuous filaments 26 has a number of free ends 28 that have been fractured from the main body section of the filament to protrude from the continuous filament along the length of the filament. It will be noted that in the sketch each filament is shown thicker than the free end which has been fractured from the filament. The filaments of this yarn are typical of the structure disclosed in U.S. Pat. No. 4,245,001, for example, and formed in the manner described in the patent. Yarns such as these provide softer, more cotton-like aesthetics. The free ends are small (relative to the total filament denier per filament), unstrained structures, hence the relatively soft aesthetics.

Figure 4:
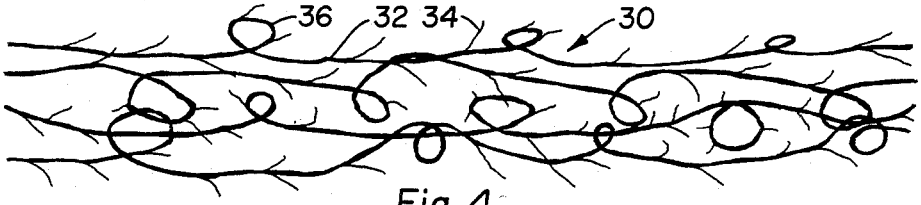
FIG. 4 is a sketch representative of the continuous filament yarn of the present invention illustrating a loopy yarn structure made from filaments having free protruding ends.
Figure 5:
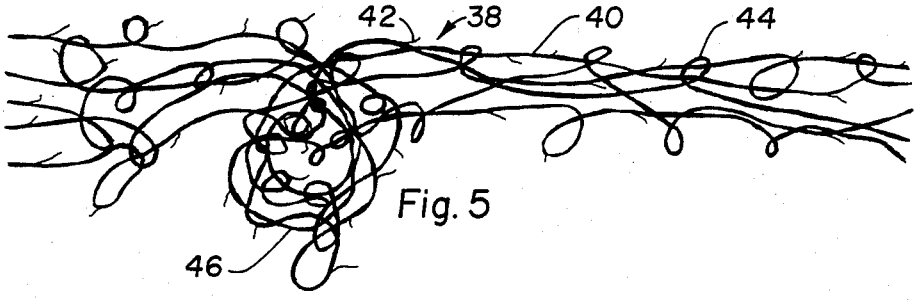
FIG. 5 is a sketch representative of an alternate embodiment of the continuous filament yarn of the present invention illustrating a loopy yarn structure made from filaments having free protruding ends and a slub formed along a portion of the length of the yarn.

FIGS. 4 and 5 illustrate yarn structures of the present invention.

FIG. 4 shows a sketch representative of a continuous yarn 30 wherein a portion thereof along the main body section of each of the continuous filaments 32 is intermittently separated from the main body section and a fraction of the separated portion is broken to provide the free protruding ends 34 extending from the main body section of the continuous filament. As in FIG. 3, each continuous filament is shown in FIG. 4 as being thicker than the free end which extends from the main body section of the continuous filament. The continuous filament also has been formed along its length into a series of ring-like loops or crunodal loops 36 at irregular intervals. Yarns such as these provide unique aesthetics as compared to known yarns such as the ones represented in the sketches of FIG. 1 and FIG. 2 and not obtainable with either alone. For example, the aesthetic might be described as a "soft wool."

FIG. 5 shows a sketch of a continuous filament yarn 38 wherein each of the continuous filaments 40 have free protruding ends 42 that have fractured from along the length of the filament, and a series of ring-like loops or crunodal loops 44 has been formed in the filament along the length thereof at irregular intervals. As in FIGS. 3 and 4, each continuous filament is shown thicker than the free end which has been fractured from the main body section of the continuous filament. The sketch also shows that a localized highly entangled knot or slub 46 has been formed in the yarn 38.

Loopy yarns of the prior art are known to have serious withdrawal problems from packages because the yarn tends to stick or adhere to the mass of unwound yarn on the package. These deficiencies are usually minimized with a slight extension of the loopy yarn to reduce the size of the large loops and proper heat-setting to further reduce the loop size. The yarns of this invention have a reduced tendency to stick upon unwinding from a package and therefore do not need these additional treatments.

Loopy yarns of the prior art having some or many of the filaments broken to provide free ends of projecting fiber will tend to be weaker from the standpoint of load-bearing than yarns of the present invention of the same material and with the same number of filaments. The reason for this is that the main body section of the continuous filaments of the present invention remains intact except for those portions along its length which intermittently separate from the main body section with a fraction of these separated portions being broken to provide the free protruding ends extending from the main body section.

Preparation of the yarns of this invention requires a special cross-section feed yarn, for example, such as the one shown in the aforementioned U.S. Pat. No. 4,245,001, which will provide the free protruding ends when the feed yarn is passed through the process. The process involves feeding a special cross-section feed yarn through an air jet that will loop the yarn as well as form the free protruding ends, such as the air jets disclosed in U.S. Pat. No. 4,041,583 and U.S. Pat. No. 3,545,057. In order to form the loops, the yarn is fed through the air jets at a rate of about 300–600 meters/-minute at an overfeed of about 5 to about 30%. Such overfeed enables the formation of the loops.

It is very surprising that the yarns of this invention can even be made. For example, it is well known that the looping takes place at the exit of the venturi section in a typical jet designed for looping, whereas I have found that fracturing takes place between the inlet needle and the venturi throat, far upstream of the looping site. It is quite surprising, therefore, that the individual filaments still have enough freedom of movement after fracturing to take up the overfeed and form loops. In other words, one skilled in the art would have thought that the newly created free ends would inhibit lateral movement and provide enough entanglement between the free ends and their filament neighbors to make loop formation essentially impossible.

It is even more surprising to me because I have even tried feeding yarns of the type I had obtained under the teachings of my U.S. Pat. No. 4,245,001, using the same jets as I disclose herein and under the same pressures. I did not obtain a loopy structure. Thus the mechanism for the formation of the yarns (shown in FIG. 4) inside the jets is unclear. The following examples are illustrative of the invention and are not to be understood as limiting the scope of the invention.

EXAMPLE I

A 270(170)/30 polyester partially oriented yarn (POY) made from poly(ethylene terephthalate) polymer and having a winged cross-section with a wing body intersection (WBI=15), such as taught in aforementioned U.S. Pat. No. 4,245,001, was drawn and heatset to yield filaments having textile utility (2.0 g/d, 25% elongation) and then looped using an air jet of the construction shown in FIG. 5 of U.S. Pat. No. 4,041,583. The pertinent process conditions were:

draw ratio: 1.55×, 95° C. feed roll temperature 0.41m (16") noncontact 240° C. slits
output speed: 400 meters/minute
jet type: Du Pont XIV
jet makeup: 0.020 B/0.056
jet conditions: 21.75 kilopascals (kPa) (150 psig) 0.184 $sm^3/m$ (6.5 scfm)

Nineteen different examples were made with overfeed being the variable, which ranged from 1% to 28% overfeed: 1, 2, 3, 4, 5, 6, 7, 8, 9, 10, 12, 14, 16, 18, 20, 22, 24, 26, and 28%. There are three types of yarns within this set of examples. The first type is typical of that disclosed, for instance, in U.S. Pat. No. 4,245,001 and is exemplified in yarns made by overfeeding from 1% to about 5%. Examples made from about 5% to about 12% overfeed represent yarns disclosed herein. The yarns made with about 14% to about 28% overfeed also represent yarns disclosed herein but have a slub effect which may be undesirable except in a novelty sense. Obviously changes in process equipment and/or conditions could be used to change the overfeeds at which the above-defined interfaces occur. The above interface definitions are not meant to imply that sudden changes occur at those conditions. The changes are gradual but distinct and are easily perceived in knit socks. Table I below shows the physical properties of the resulting yarns.

TABLE I

| Sample Number | Properties of Yarns Produced in Example I | | | | |
|---|---|---|---|---|---|
| | Tenacity g/d | Elongation % | Modulus g/d | BWS* % | Normal Uster % U |
| 1 | 1.7 | 29 | 43 | 6.1 | 1.20 |
| 2 | 1.7 | 30 | 36 | 6.1 | 1.29 |
| 3 | 1.8 | 32 | 32 | 6.1 | 1.38 |
| 4 | 1.7 | 29 | 28 | 6.1 | 1.52 |
| 5 | 1.7 | 29 | 25 | 6.1 | 1.69 |
| 6 | 1.7 | 30 | 22 | 6.1 | 1.90 |
| 7 | 1.6 | 28 | 20 | 6.1 | 2.25 |
| 8 | 1.5 | 25 | 18 | 6.1 | 2.38 |
| 9 | 1.5 | 25 | 16 | 6.1 | 2.52 |
| 10 | 1.5 | 29 | 14 | 6.1 | 2.72 |
| 11 | 1.4 | 26 | 13 | 6.1 | 3.15 |
| 12 | 1.5 | 31 | 12 | 6.1 | 3.90 |
| 13 | 1.4 | 29 | 12 | 6.1 | 4.60 |
| 14 | 1.4 | 27 | 12 | 6.1 | 5.00 |
| 15 | 1.4 | 31 | 12 | 6.1 | 5.60 |
| 16 | 1.4 | 35 | 10 | 6.1 | 5.55 |
| 17 | 1.3 | 30 | 9 | 6.1 | 6.00 |
| 18 | 1.3 | 31 | 9 | 6.1 | 6.50 |

TABLE I-continued

| Sample Number | Properties of Yarns Produced in Example I | | | | |
|---|---|---|---|---|---|
| | Tenacity g/d | Elongation % | Modulus g/d | BWS* % | Normal Uster % U |
| 19 | 1.3 | 33 | 7 | 6.1 | 7.10 |

*Boiling Water Shrinkage

EXAMPLE II Example I was repeated except that a two-ply yarn was used [2/270(170)/30]. All processing conditions were identical to those disclosed in Example I. Again, there were three different types of yarn identical to that disclosed in Example I; however, the interface locations are not identical:

| | |
|---|---|
| Type 1 | 1%-5% overfeed<br>U.S. Pat. No. 4,245,001 |
| Type 2 | 5%-20% overfeed<br>present invention |
| Type 3 | 20%-28% overfeed<br>present invention with slubs |

Table II below shows the physical properties of the resulting yarns.

TABLE II

| Sample Number | Properties of Yarns Produced in Example II | | | | |
|---|---|---|---|---|---|
| | Tenacity g/d | Elongation % | Modulus g/d | BWS* % | Normal Uster % U |
| 1 | 1.6 | 20 | 49 | 7.4 | 0.55 |
| 2 | 1.6 | 21 | 42 | 7.4 | 0.52 |
| 3 | 1.7 | 21 | 38 | 7.4 | 0.71 |
| 4 | 1.6 | 23 | 32 | 7.4 | 0.75 |
| 5 | 1.6 | 23 | 30 | 7.4 | 0.35 |
| 6 | 1.6 | 22 | 27 | 7.4 | 0.99 |
| 7 | 1.6 | 22 | 28 | 7.4 | 1.19 |
| 8 | 1.6 | 22 | 25 | 7.4 | 1.34 |
| 9 | 1.6 | 21 | 28 | 7.4 | 1.48 |
| 10 | 1.6 | 20 | 35 | 7.4 | 1.53 |
| 11 | 1.5 | 22 | 17 | 7.4 | 1.39 |
| 12 | 1.5 | 22 | 16 | 7.4 | 1.80 |
| 13 | 1.5 | 22 | 15 | 7.4 | 2.02 |
| 14 | 1.5 | 23 | 14 | 7.4 | 2.03 |
| 15 | 1.5 | 22 | 16 | 7.4 | 2.43 |
| 16 | 1.4 | 18 | 16 | 7.4 | 2.32 |
| 17 | 1.5 | 23 | 15 | 7.4 | 2.49 |
| 18 | 1.5 | 24 | 16 | 7.4 | 2.60 |
| 19 | 1.5 | 23 | 15 | 7.4 | 2.77 |

*Boiling Water Shrinkage

EXAMPLE III

Example I was repeated except that a three-ply yarn was used [3/170(110/24]. All processing conditions were identical to those disclosed in Example I. Three types of yarn are present with the following overfeed interface locations:

| | |
|---|---|
| Type 1 | 1%-5% |
| Type 2 | 5%-26% |
| Type 3 | 28% |

TABLE III

| Sample Number | Properties of Yarns Produced in Example III | | | | |
|---|---|---|---|---|---|
| | Tenacity g/d | Elongation % | Modulus g/d | BWS* % | Normal Uster % U |
| 1 | 2.2 | 20 | 58 | 6.0 | 0.80 |
| 2 | 2.1 | 20 | 51 | 6.0 | 0.90 |
| 3 | 2.2 | 22 | 46 | 6.0 | 0.90 |
| 4 | 2.2 | 22 | 40 | 6.0 | 1.00 |
| 5 | 2.1 | 21 | 34 | 6.0 | 1.20 |

TABLE III-continued

| Sample Number | Properties of Yarns Produced in Example III | | | | |
|---|---|---|---|---|---|
| | Tenacity g/d | Elongation % | Modulus g/d | BWS* % | Normal Uster % U |
| 6 | 2.1 | 20 | 34 | 6.0 | 1.40 |
| 7 | 2.1 | 24 | 29 | 6.0 | 1.60 |
| 8 | 2.1 | 24 | 28 | 6.0 | 1.80 |
| 9 | 2.0 | 21 | 26 | 6.0 | 2.10 |
| 10 | 2.0 | 20 | 28 | 6.0 | 2.50 |
| 11 | 1.9 | 20 | 26 | 6.0 | 2.90 |
| 12 | 1.7 | 18 | 22 | 6.0 | 3.20 |
| 13 | 1.8 | 18 | 25 | 6.0 | 3.20 |
| 14 | 1.8 | 20 | 23 | 6.0 | 3.40 |
| 15 | 1.7 | 19 | 21 | 6.0 | 3.50 |
| 16 | 1.7 | 17 | 24 | 6.0 | 2.80 |
| 17 | 1.6 | 17 | 20 | 6.0 | 4.10 |
| 18 | 1.6 | 18 | 21 | 6.0 | 4.20 |
| 19 | 1.6 | 16 | 17 | 6.0 | 4.70 |

*Boiling Water Shrinkage

EXAMPLE IV

Example I was repeated except the 270(170)/30 POY had a round cross-section. All processing conditions were the same as for Example I. Having only 30 filaments was a severe restriction as very little looping occurred up to 28% overfeed. The overfeed was taken up in small localized sections of high loop content which resembled slubs. None of these yarns produced any desirable effect, which is in stark contrast to the yarns produced in Example I.

EXAMPLE V

Example IV was repeated except that a two-ply yarn was used [2/270(170)/30 round cross-section]. All processing conditions were the same as for Example IV. None of these yarns produced any desirable effects. This strongly suggests that 5 denier per filament is too large for round yarns whereas it seems acceptable for the winged section.

As heretofore mentioned, the number of crunodal loops formed may vary from about 50 to about 1500 per meter. The fractured free protruding ends projecting from each of the continuous filaments will have a mean separation distance along a filament of about one to about 10 millimeters, and a mean length of about one to about ten millimeters, as disclosed in U.S. Pat. No. 4,245,001. The yarns disclosed herein are useful for making apparel and homefurnishings fabrics. The invention has been described in detail with particular reference to preferred embodiments thereof, but it will be understood that variations and modifications can be effected within the spirit and scope of the invention.

I claim:

1. A textile yarn having a staple yarn character and including continuous filaments, each continuous filament formed into coils, loops or whorls at random intervals along its length and comprising a continuous main body section having a portion thereof along the length of the main body section being intermittently separated from the main body section and a fraction of said intermittently separated portion being broken and providing free ends extending from said main body section.

2. A textile yarn as defined in claim 1 wherein said yarn has along its length about 50 to about 1500 crunodal loops per meter.

3. A textile yarn as defined in claim 1 wherein said fractured free protruding ends projecting from each of said continuous filaments have a mean separation distance along a filament of about one to about ten millimeters.

4. A textile yarn as defined in claim 1 wherein said fractured free protruding ends projecting from each of said continuous filaments have a mean length of about one to about ten millimeters.

5. A textile yarn as defined in claim 1 wherein said yarn has formed therein localized highly entangled knots or slubs at intervals along the length thereof.

* * * * *